United States Patent [19]

Lee

[11] 4,386,466

[45] Jun. 7, 1983

[54] CRUTCH GAUGE MEASURING DEVICE

[75] Inventor: LeRoy J. Lee, Fayetteville, N.C.

[73] Assignee: Dale L. Avers, Versailles, Ky. ; a part interest

[21] Appl. No.: 293,104

[22] Filed: Aug. 17, 1981

[51] Int. Cl.[3] ..... A61H 3/02

[52] U.S. Cl. ..... 33/174 D; 33/161; 135/69

[58] Field of Search ..... 33/174 D, 161; 135/69, 135/68, 75

[56] References Cited

U.S. PATENT DOCUMENTS

| | | | |
|---|---|---|---|
| 1,505,081 | 8/1924 | Arndt | 135/68 |
| 2,590,607 | 3/1952 | Grimball | 135/69 |
| 2,614,332 | 10/1952 | Zadrozny | 33/174 D |
| 2,674,253 | 4/1954 | Hopkins | 135/69 |
| 3,730,198 | 5/1973 | Johnston et al. | 135/69 |

FOREIGN PATENT DOCUMENTS

| | | | |
|---|---|---|---|
| 4761 | 10/1979 | European Pat. Off. | 135/69 |

*Primary Examiner*—Willis Little

*Attorney, Agent, or Firm*—Frank C. Leach, Jr.

[57] ABSTRACT

A crutch gauge has an adjustable extension leg movable vertically in either direction relative to a pair of side members, which are the same length as the side members of a standard crutch, to enable determination of the length of an adjustable extension leg that is to extend beyond the side members of the crutch for a person being fitted. The crutch gauge includes a locking arrangement that enables the person, who is being fitted, to be supported by the crutch gauge while walking. The movement of the adjustable extension leg of the crutch gauge in either direction is accomplished without a person, who is fitting the person, having to bend over. The crutch gauge includes an adjustably positioned handle, which is disposed in one of five positions in accordance with the person being fitted.

20 Claims, 11 Drawing Figures

CRUTCH GAUGE MEASURING DEVICE

One type of crutch for supporting a person is formed of metallic tubular elements. The crutch includes a pair of side members secured to each other at a plurality of spaced longitudinal portions including the upper and lower ends of the side members. At their lower ends, the two side members are secured to each other by bolts and nuts with an adjustable extension leg, which supports the crutch, extending from the lower ends of the two side members for a selected length and being joined together with the two side members at a specific location by two bolts and nuts.

If a therapist, for example, seeks to fit a person with this type of crutch, it is necessary to determine how far that the extension leg must extend beyond the lower ends of the side members to provide a comfortable fit for the user. The therapist attempts to estimate the length of the extension leg that should extend beyond the lower ends of the side members. To determine if this estimated length produces a comfortable fit, it is necessary for the therapist to lock the extension leg in this position to the lower ends of the two side members by the two bolts and nuts. This is a time consuming task. However, it is necessary in order for the crutch to be capable of properly supporting the user.

It is necessary for the person, who is being fitted, to walk and be supported by the crutch for several minutes to ascertain if the crutch is comfortable at its overall length as determined by the length of the extension leg extending beyond the lower ends of the side members. If the therapist has not correctly estimated the length of the extension leg extending beyond the side members, it is necessary to remove the two bolts and nuts and change the length of the extension leg extending beyond the lower ends of the side members of the crutch. Then, the extension leg is again locked to the lower ends of the side members by the two bolts and nuts and the person, who is being fitted, again uses the crutch to ascertain if the new position of the extension leg produces the correct overall length of the crutch for comfortable use.

There is a plurality of aligned holes in the extension leg to receive the two bolts, which join the extension leg to the two side members at the lower ends of the side members. Therefore, the therapist can know, during the second attempt, where the extension leg was previously located. However, even the second position of the extension leg may not be satisfactory so that a third effort must be made. This again requires the removal of the extension leg from the lower ends of the side members of the crutch by disconnecting the two bolts and nuts and then shifting the position of the extension leg relative to the side members to again enable securing of the extension leg to the side members by the two bolts and nuts. Thus, this can become a relatively time consuming task for the therapist.

At the same time that the length of the crutch must be determined through changing the portion of the extension leg extending beyond the lower ends of the side members, it also is necessary to ascertain the location of the handle, which is gripped by the hand of the person using the crutch, on the side members. Since the handle is secured to the crutch by a bolt and nut with the bolt passing through one of the side members, a longitudinal passage in the handle, and the other side member prior to receiving the nut, this also is a time consuming task. In some instances, the shifting of the position of the extension leg requires changing of the position of the handle. That is, there is a different feel to the person, who is being fitted with the crutch, when the overall length of the crutch is changed.

One previous type of crutch gauge is shown in U.S. Pat. No. 2,614,332 to Zadrozny. The crutch gauge of the aforesaid Zadrozny patent has an arrangement for obtaining the overall length of a crutch and the location of the crutch handle.

The crutch gauge of the aforesaid Zadrozny patent has the disadvantage of requiring the therapist, who is doing the fitting, to bend over to release and tighten various screws. This also has the disadvantage of the screws possibly failing to provide a positive locking relation in all situations. Thus, if a screw should not be completely tightened and the person attempted to walk on the crutch gauge of the aforesaid Zadrozny patent, there is the possibility that the person could be injured because of shifting of the parts causing the crutch gauge to not support the person using it.

Furthermore, the crutch gauge of the aforesaid Zadrozny patent does not provide support between the elements which are movable relative to each other in the direction in which force is exerted by the user. That is, the connection of one of the movable elements to the other is through a slot receiving a clamping screw with no support surface for the clamping screw in the direction in which the force is exerted. Therefore, while the crutch gauge of the aforesaid Zadrozny patent is indicated as being capable of use as a regular crutch with certain minor changes, the crutch gauge of the aforesaid Zadrozny patent has the problem of the parts possibly moving relative to each other because of the failure to provide suitable support surfaces for the elements required to carry the load produced by the person using the crutch gauge when the person is supported by the crutch gauge.

Another form of a crutch measuring device is described in an article by Sidney M. Dawe on pages 94 and 95 of the March 1951 issue of The Physical Therapy Review. This device utilized an extension leg of wood with a ratchet arrangement to enable movement of the side members of wood relative to the extension leg only in an upward direction to increase the overall length. Thus, with this crutch measuring device, any downward motion of the side members relative to the extension leg to decrease the overall length could not be accomplished without releasing the ratchet. Therefore, to decrease the overall length, the therapist had to bend over to release the ratchet and push down to move the side members downwardly relative to the extension leg, even one notch. At this time, the person, who was being fitted, could not be supported by the therapist.

Furthermore, this prior crutch measuring device also required the ratchet to provide the sole locking arrangement when the crutch measuring device is used by the person being fitted. This is a relatively heavy load to be carried by a ratchet.

In this previous crutch measuring device, the handle could be adjustably disposed at various locations through a pin on a spring snapping into drilled holes in the side members. However, this handle can twist since it is supported solely by the pins extending into the drilled holes. Thus, it may not always provide the necessary handle support to the person being fitted.

Another type of crutch measuring device is described in an article by Jay Davenport on page 591 of the August 1960 issue of The Physical Therapy Review. This device has an extending leg of wood formed with a longitudinal slot to receive two bolts, which extend through holes in the side members of wood. This provided no bearing support for the bolts in the slot of the extending leg. It also required the therapist to bend over to tighten the nuts on the bolts. According to the aforesaid Davenport article, this particular device should not be used for actual weight bearing. Thus, the person, who is being fitted, cannot determine how the crutch, which will be selected by matching against the crutch measuring device, will feel when the selected crutch is supporting the person.

Another crutch measuring device is described in an article by Theodore T. Tagawa on pages 113 and 114 of the February 1963 issue of the Journal of American Physical Therapy Association. This crutch measuring device has an extension leg formed with a longitudinal slot to receive two bolts and nuts for securing to two side members. This crutch measuring device is not recommended to be used for walking.

Still another crutch measuring device is described on pages 123 and 124 of the February 1967 issue of the Journal of American Physical Therapy Association in an article by James J. Bosanny et al. This device uses a handle similar to that described in the aforesaid Dawe article. The device uses bolts and nuts to secure a length insert to the crutch.

Another type of axillary measuring crutch is described on page 1107 of the October 1975 issue of The Physical Therapy Review in an article by Meryle Herbst et al. This crutch is described as not being sufficiently stable for sustained ambulation so that it has the same problem as the other crutch measuring devices in providing necessary support to enable the person, who is being fitted, to get the feel of the crutch at the selected overall length.

The crutch gauge of the present invention satisfactorily solves the foregoing problems through providing an adjustable extension leg that may have the side members, which are the same length as the side members of a standard crutch, easily moved upwardly or downwardly relative to the adjustable extension leg with the therapist standing in a vertical position. Thus, there is no necessity for the therapist to bend over so that the therapist can always support the person, who is being fitted.

Furthermore, the adjustable extension leg is locked in any position at the lower ends of the side members of the crutch gauge by a locking mechanism that allows the person, who is being fitted, to be supported by the crutch gauge when the person walks. The enables the person to get the feel of the specific selected length of the crutch to ascertain if it is comfortable. During this entire time, the therapist is standing and is ready to aid the person, who is being fitted, and can quickly increase or decrease the length of the adjustable extension leg extending beyond the lower ends of the side members. Therefore, determination of the overall length of a crutch is quickly and safely obtained when using the crutch gauge of the present invention through ascertaining the length of the adjustable extension leg extending beyond the lower ends of the side members of the crutch gauge.

The crutch gauge of the present invention also enables quick determination of the location of the handle. The crutch gauge of the present invention utilizes a telescoping handle in which there can be no rotational movement of the handle after it is disposed in any of the vertical positions in which it may be disposed between the side members. Thus, positive support is provided to the person, who is being fitted, when the handle is grasped since it cannot twist or turn.

An object of this invention is to provide a unique crutch gauge.

Another object of this invention is to provide a crutch gauge capable of supporting a person, who is being fitted, during walking with the crutch gauge.

Other objects of this invention will be readily perceived from the following description, claims, and drawings.

This invention relates to a crutch gauge for determining the length of a crutch for a person. The crutch gauge includes a pair of side members secured to each other at spaced longitudinal portions by a plurality of securing means. An adjustable extension leg extends between the side members at their lower ends to engage a floor or the like to support the side members. The crutch gauge has means to releasably lock the adjustable extension leg to the side members and means to render the releasable locking means ineffective while each of the securing means remains effective to enable relative movement between the side members and the adjustable extension leg so that the overall length of a crutch may be determined.

The attached drawings illustrate a preferred embodiment of the invention, in which.

Figure 1:
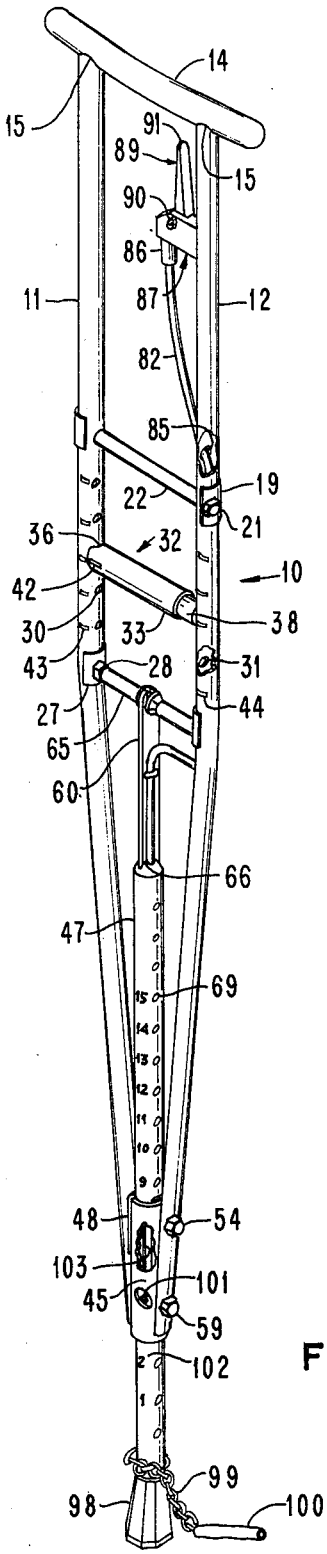
FIG. 1 is a perspective view of the crutch gauge of the present invention.

Referring to the drawings and particularly FIG. 1, there is shown a crutch gauge 10 for use in determining the length of a crutch to be used by a person being fitted. The crutch gauge 10 includes a pair of side members 11 and 12, which are metal tubes and have the same length as the side members of a standard crutch, secured to each other at a plurality of spaced longitudinal portions.

Figure 11:
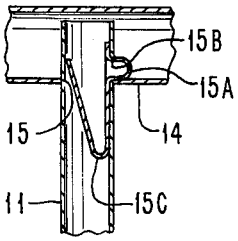
FIG. 11 is a fragmentary sectional view showing the connection between one of the side members and the shoulder saddle of the crutch gauge of FIG. 1.

The upper ends of the side members 11 and 12 are secured to each other by a shoulder saddle 14 of metal. The shoulder saddle 14 has a pair of holes 15 in its lower surface to receive the upper ends of the side members 11 and 12. Each of the side members 11 and 12 is secured to the shoulder saddle 15 by any suitable means. One suitable securing means is for each of the side members 11 and 12 to have a plunger 15A (see FIG. 11) urged outwardly through a hole 15B in the side member 11 or 12 by a resilient element 15C, which is integral with the plunger 15A, so that the plunger 15A bears against the lower surface of the shoulder saddle 14. The shoulder saddle 14 fits underneath the arm pit of the person, who is being fitted, to support the shoulder.

Figure 2:
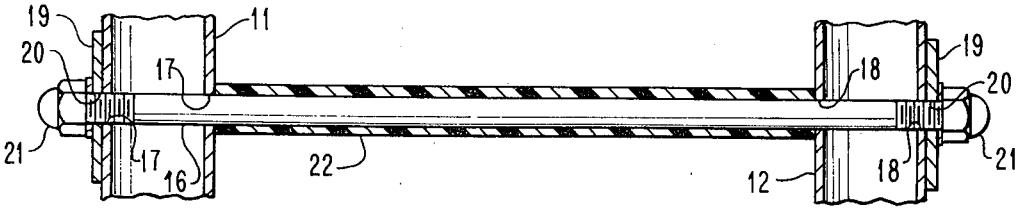
FIG. 2 is a longitudinal sectional view of one of the securing means of the crutch gauge of the present invention and mounted between the side members of the crutch gauge.

As shown in FIG. 2, the side members 11 and 12 also are secured to each other at a spaced longitudinal distance from their upper ends by a horizontally disposed, threaded steel rod 16, which extends through a pair of aligned holes 17 in the side member 11 and a pair of aligned holes 18 in the side member 12. A reinforcing cap 19, which is preferably a short length of split tubing, is disposed on the exterior of each of the side members 11 and 12 to prevent collapse of the side members 11 and 12 in the area having the holes 17 and 18, respectively. Each of the reinforcing caps 19 has an opening 20 therein through which the ends of the rod 16 extend. An acorn nut 21 is attached to each end of the rod 16 to enable the side members 11 and 12 to be held at a substantially constant distance from each other along the rod 16.

A protective tube 22 surrounds the rod 16 between the side members 11 and 12. The tube 22 is formed of any suitable soft material such as vinyl or rubber, for example, to prevent snagging of the skin or clothing of the person being fitted or the therapist.

Figure 4:
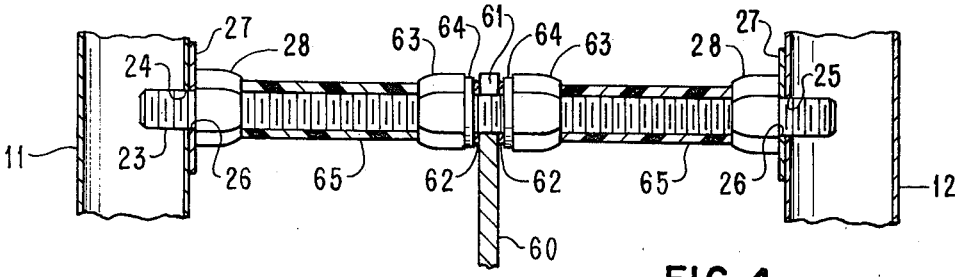
FIG. 4 is a longitudinal sectional view of another of the securing means of the crutch gauge of the present invention and mounted between the side members of the crutch gauge.

The side members 11 and 12 also are joined to each other by a horizontally disposed, threaded steel rod 23 (see FIG. 4). One end of the rod 23 extends into a hole 24 in the inner surface of the side member 11 while the other end of the rod 23 extends into a hole 25 in the inner surface of the side member 12. Each end of the rod 23 passes through an opening 26 in a reinforcing cap 27 prior to entering the holes 24 and 25. The reinforcing caps 27, which are similar to the reinforcing caps 19, reinforce the side members 11 and 12 to prevent collapsing of the side members 11 and 12 in the area of the holes 24 and 25, respectively.

An acorn nut 28 is threaded on the steel rod 23 inside of each of the reinforcing caps 27. The acorn nuts 28 are loosened and/or tightened to adjust and maintain the proper distance between the side members 11 and 12.

Between the holes 17 (see FIG. 2) and 24 (see FIG. 4), the inner surface of the side member 11 has five vertically spaced holes 30 (see FIG. 1). Between the holes 18 (see FIG. 2) and 25 (see FIG. 4), the inner surface of the side member 12 has five holes 31 (see FIG. 1) with each of the holes 31 being horizontally aligned with one of the holes 30 in the side member 11. The holes 30 and 31 cooperate to enable a horizontally disposed, telescoping handle 32 to be supported by any two of the aligned holes 30 and 31. It should be understood that the number of the holes 30 and 31 may be lesser or greater than five as desired.

Figure 3:
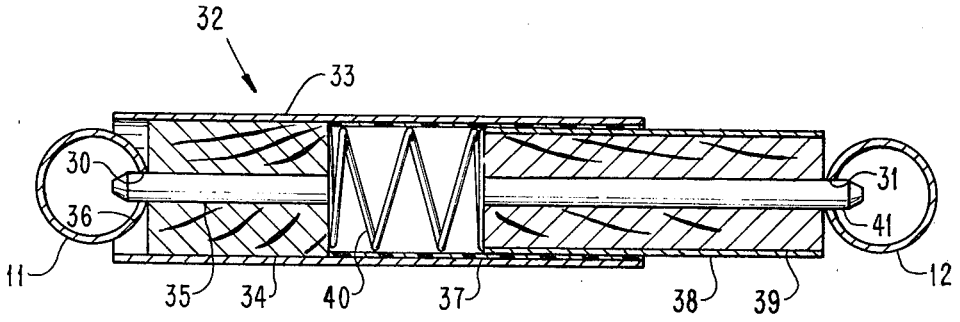
FIG. 3 is a cross sectional view of the elements forming the telescoping handle of the crutch gauge of the present invention and mounted between the side members of the crutch gauge.

The telescoping handle 32 includes a metal tube 33 (see FIG. 3) having one end closed by a plug 34, which is formed of a suitable material such as wood, for example. The plug 34 has a pin 35 fixed therein and extending therefrom for disposition within one of the holes 30 (see FIG. 1) in the side member 11. The metal tube 33 has its end, which receives the plug 34 (see FIG. 3), formed with a pair of diametrically disposed curved grooves or recesses 36 to enable the end of the tube 33 to fit around the curved inner surface of the side member 11 to prevent axial twisting of the telescoping handle 32 by the user.

The tube 33 has a liner 37, which is formed of a suitable low coefficient of friction material such as nylon or vinyl, for example, secured by a suitable adhesive to its inner surface in the portion of the tube 33 not having the plug 34. The liner 37 enables a metal tube 38 to slidably move in and out of the tube 33.

The tube 38 is completely filled by a plug 39, which may be formed of any suitable material such as wood, for example. A spring 40, which is disposed within the tube 33, has one end acting against one end of the plug 34 and its other end acting against the plug 39 in the tube 38 to urge the tube 38 outwardly from the tube 33. The plug 39 has a pin 41 fixed therein and extending therefrom for disposition within one of the holes 31 in the side member 12. Accordingly, the telescoping handle 32 may be easily shifted to any of the five vertical positions, as defined by the five holes 30 (see FIG. 1) in the side member 11 and the five holes 31 in the side member 12, in accordance with the most comfortable position for the user.

The tube 33 of the telescoping handle 32 has indicia marks 42 on opposite sides of its end having the grooves or recesses 36 for cooperation with vertically spaced indicia marks 43 on the side member 11. Since the telescoping handle 32 can have the pin 35 (see FIG. 3) disposed in one of the holes 31 in the side member 12 and the pin 41 disposed in one of the holes 30 in the side member 11, there also are vertically spaced indicia marks 44 (see FIG. 1) on the side member 12 for cooperating with the marks 42 on the tube 33. Both sides of the side member 11 have the indicia marks 43, and both sides of the side member 12 have the indicia marks 44.

Figure 6:
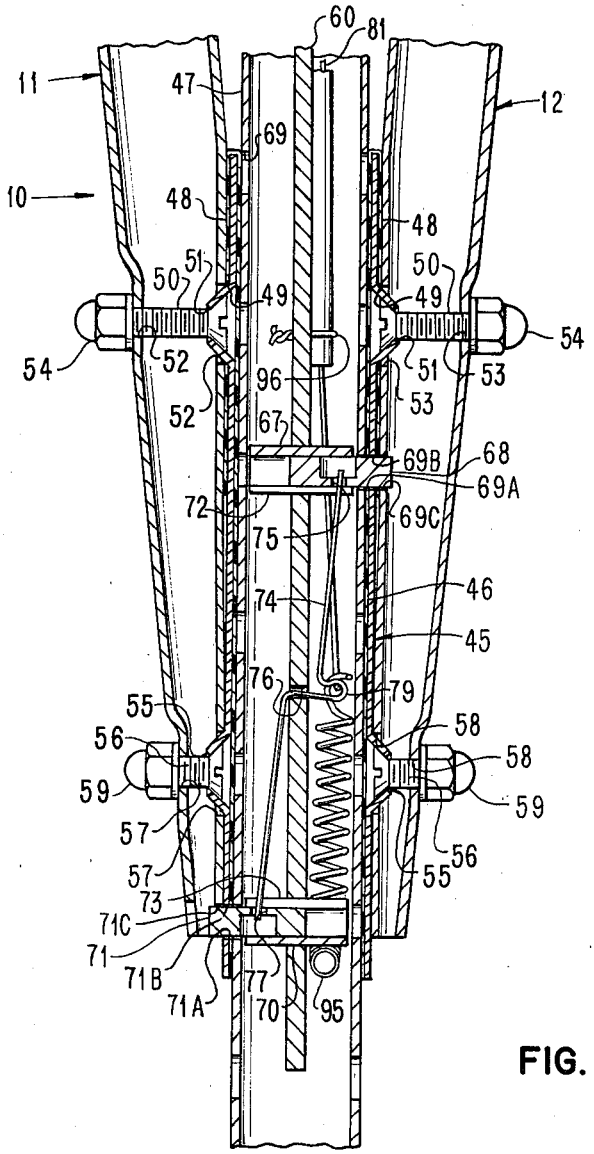
FIG. 6 is a longitudinal sectional view of the lower portion of the crutch gauge of FIG. 1.

The lower ends of the side members 11 and 12 are secured to each other by securing means including a metal tube 45 disposed between the lower ends of the side members 11 and 12. The tube 45 has a liner 46 (see FIG. 6), which is formed of a suitable low coefficient of friction material such as nylon or vinyl, for example, disposed therein to enable an adjustable extension leg 47, which is a metal tube, to slide vertically therethrough in either direction.

The upper end of the liner 46 has a pair of diametrically disposed ears 48 extending over the outer surface of the upper end of the tube 45 and bearing against the inner surfaces of the side members 11 and 12. Each of the two ears 48 has a hole 49 therein to enable one of a pair of bolts 50 to extend therethrough after passing through one of a pair of diametrically disposed holes 51 in the tube 45. Each of the bolts 50 then extends through a pair of aligned holes 52 in the side member 11 or a pair of aligned holes 53 in the side member 12. Each of the bolts 50 is secured in position by an acorn nut 54.

Each of the holes 51 in the tube 45 is countersunk from the inner surface of the tube 45 to its outer surface to accommodate the flat head of the bolt 50 disposed therein. Thus, the heads of the bolts 50 do not project into the interior of the tube 45 to interfere with the liner 46 or the adjustable extension leg 47.

The tube 45 has a second set of aligned and diametrically disposed holes 55 with each of the holes 55 receiving a bolt 56. One of the bolts 56 passes through one of the holes 55 into a pair of aligned holes 57 in the side member 11 while the other of the bolts 56 passes through a pair of aligned holes 58 in the side member 12. Each of the bolts 56 is retained in position by an acorn nut 59. Each of the holes 55 is countersunk in the same manner as the holes 51 and for the same purpose.

The adjustable extension leg 47 is slidably mounted on a flat bar 60, which extends into the upper end of the adjustable extension leg 47. The flat bar 60 has its upper end terminate in a slot 61 (see FIG. 4) to fit around the threaded rod 23.

The flat bar 60 is held in a desired position on the rod 23 so that it is vertically disposed by a pair of lock washers 62, which are mounted on the rod 23 and bear against opposite sides of the slotted upper end of the flat bar 60. Acorn nuts 63, which also are mounted on the threaded steel rod 23, act through flat washers 64 to hold the flat bar 60 in the desired position on the threaded steel rod 23.

The portions of the threaded steel rod 23 between each of the acorn nuts 28 and the adjacent acorn nut 63 are covered with protective tubes 65. Each of the protective tubes 65 is formed of a suitable soft material such as vinyl or rubber, for example, to prevent snagging of skin or clothing of the user or the therapist.

The closed upper end of the adjustable extension leg 47 (see FIG. 7) has a slot 66 to receive the flat bar 60. The structural relationship of the slot 66 in the adjustable extension leg 47 and the flat bar 60, which has a width substantially the same as the diameter of the inner surface of the tube forming the adjustable extension leg 47 but with a slight clearance, prevents twisting or rotary motion of the adjustable extension leg 47 to insure that the relative motion between the flat bar 60 and the adjustable extension leg 47 is vertical.

The lower portion of the flat bar 60 has an upper latch bolt barrel 67 (see FIG. 6) supported thereby and extending substantially between diametrically disposed portions of the inner surface of the adjustable extension leg 47 but slightly spaced therefrom to not interfere with relative movement between the adjustable extension leg 47 and the flat bar 60. The barrel 47, which is a cylindrical shaped tube, slidably receives an upper latch bolt 68 therein.

The upper latch bolt 68 is movable into and out of one of a plurality of pairs of aligned holes 69 in the adjustable extension leg 47, a hole 69A in the liner 46, a hole 69B in the tube 45, and a hole 69C in the inner surface of the side member 12. The pairs of aligned holes 69 are spaced vertically from each other the same constant distance as the pairs of aligned holes in the adjustable extension leg of a crutch, which may be metal or wood.

The lower portion of the flat bar 60 has a lower latch bolt barrel 70 supported thereby and extending substantially between diametrically disposed portions of the inner surface of the adjustable extension leg 47 but slightly spaced therefrom to not interfere with relative movement between the adjustable extension leg 47 and the flat bar 60. The lower latch bolt barrel 70, which is a cylindrical shaped tube, slidably supports a lower latch bolt 71 for movement into and out of one of the plurality of pairs of aligned holes 69 in the adjustable extension leg 47 and on the opposite side of the adjustable extension leg 47 from the hole 69 receiving the upper latch bolt 68. After passing through one of the holes 69 in the adjustable extension leg 47, the lower latch bolt 71 passes through a hole 71A in the liner 46 and a hole 71B in the tube 45. The lower latch bolt 71 rests in a semicircular cutout 71C at the bottom of the side member 11.

To insure that the adjustable extension leg 47 remains in its locked position when the crutch gauge 10 is used for walking by the person being fitted, the lower latch bolt 71 extends into one of the plurality of pairs of holes 69 that is not in the same plane as that into which the upper latch bolt 68 extends. While a locking mechanism could be devised in which the upper latch bolt 68 and the lower latch bolt 71 could be in the same plane, this is not believed to provide the same strength and support as is obtained by the vertical spacing of the latch bolts 68 and 71.

The upper latch bolt barrel 67 has a longitudinal slot 72 at its lowermost portion for the entire length of the upper latch bolt barrel 67 while the lower latch bolt barrel 70 has a longitudinal slot 73 in its uppermost portion for the entire length of the lower latch bolt barrel 70. The slot 72 enables one end of a latch bolt actuator 74, which is a spring steel wire, to pass therethrough into a hole 75 in the upper latch bolt 68. The hole 75 is only slightly larger than the actuator 74 at the entry of the actuator 74 into the hole 75. However, the remainder of the hole 75 is larger to accommodate the sweep of the end of the actuator 74 as it moves with the upper latch bolt 68 with the actuator 74 pivoting relative to the latch bolt 68.

The latch bolt actuator 74 extends through a passage 76 in the flat bar 60 and has its other end pass through the slot 73 in the lower latch bolt barrel 70 to enable the other end of the latch bolt actuator 74 to enter a hole 77 in the lower latch bolt 71. The hole 77 has the same configuration as the hole 75 and for the same purpose.

Figure 5:
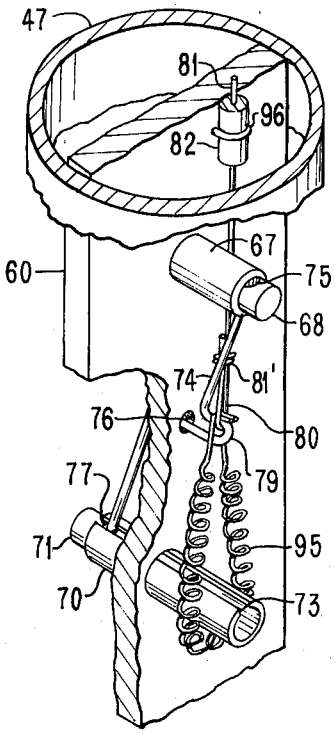
FIG. 5 is an enlarged perspective view, partly in section, of a locking means for releasably locking the adjustable extension leg to the side members of the crutch gauge of the present invention.

The latch bolt actuator 74 has a loop 79 (see FIG. 5) connected to a lower end loop 80 of a Bowden cable 81. The lower end loop 80 of the Bowden cable 81 is formed by having its free end attached to a portion of the Bowden cable 81 by a wire keeper 81'.

Figure 7:
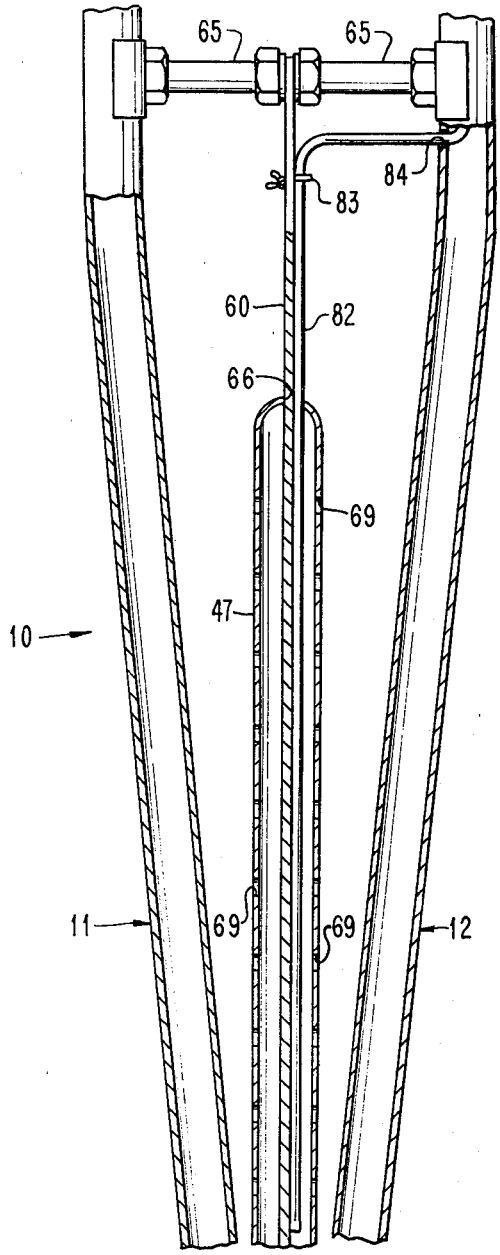
FIG. 7 is a longitudinal sectional view of an intermediate portion of the crutch gauge of FIG. 1 and forming a continuation of FIG. 6.

The Bowden cable 81 is enclosed in a sheath 82 with the sheath 82 extending upwardly inside the adjustable extension leg 47 and exiting through the closed upper end of the adjustable extension leg 47 as shown in FIG. 7. The sheath 82 is secured to the upper end of the flat bar 60 by a wire keeper 83.

Figure 8:
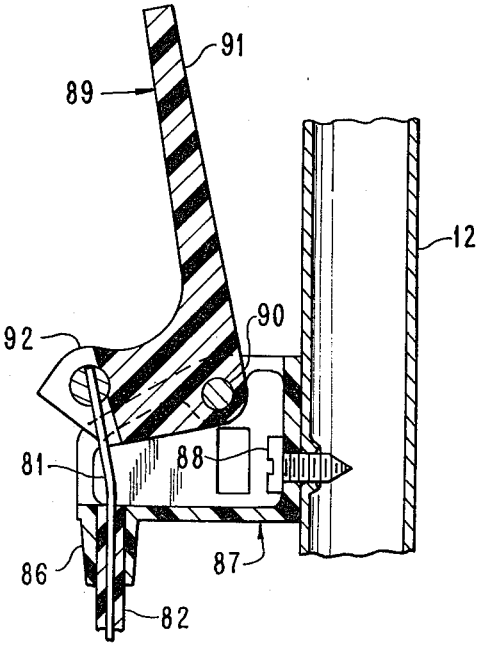
FIG. 8 is a sectional view of means for releasing the locking means of FIG. 5.

The sheath 82 extends through a hole 84 in the inner surface of the side member 12 so as to extend upwardly through the side member 12, which is a metal tube, and exit through a hole 85 (see FIG. 1) above the threaded steel rod 16. The sheath 82 with the Bowden cable 81 extends into a hollow projection 86 of a housing 87, which is secured to the side member 12 by a self-tapping sheet metal screw 88 (FIG. 8).

Figures 9, 10:
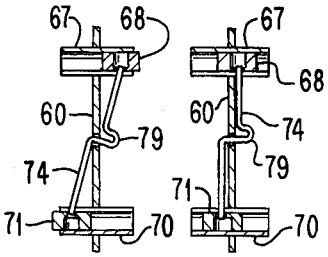
FIG. 9 is a schematic sectional view showing the locking means in its non-locking position.
FIG. 10 is a schematic sectional view showing the locking means in its locking position.

The housing 87 has a lever 89 pivotally mounted thereon by a pivot pin 90. The lever 89 includes a handle 91 at its upper end and an arm 92 for attachment to the Bowden cable 81. Accordingly, when the lever 89 is pivoted clockwise about the pivot pin 90, the Bowden cable 81 is pulled upwardly to pull the lower end loop 80 (see FIG. 5) upwardly therewith. This retracts the upper latch bolt 68 into the upper latch bolt barrel 67 and the lower latch bolt 71 into the lower latch bolt barrel 70 as shown in FIG. 9. As a result, the adjustable extension leg 47 (see FIG. 6) is no longer locked to the side members 11 and 12 through the latch bolts 68 and 71 being disposed in two of the vertically spaced holes 69 in the adjustable extension leg 47, the holes 69A and 71A, respectively, in the liner 46, and the holes 69B and 71B, respectively, in the tube 45.

Thus, when the lever 89 (see FIG. 8) is pivoted clockwise, the side members 11 (see FIG. 6) and 12 may be moved up or down relative to the adjustable extension leg 47 to change the overall length of the crutch gauge 10. This overall length is utilized through the position of the adjustable extension leg 47 to determine the length of the crutch for the person, who is being fitted.

The lower end loop 80 (see FIG. 5) of the Bowden cable 81 has both ends of a spring 95 attached thereto with the spring 95 being passed around the outer surface of the lower latch bolt barrel 70. Therefore, the spring 95 continuously urges the Bowden cable 81 downwardly so that the latch bolt actuator 74 moves the upper latch bolt 68 out of the upper latch bolt barrel 67 and the lower latch bolt 71 out of the lower latch bolt barrel 70, as shown in FIG. 10, whereby the vertically spaced latch bolts 68 and 71 extend into two of the holes 69 (see FIG. 6) in the adjustable extension leg 47, the holes 69A and 71A, respectively, in the liner 46, and the holes 69B and 71B, respectively, in the tube 45 to lock the adjustable extension leg 47 to the side members 11 and 12. Thus, whenever the handle 91 (see FIG. 8) of the lever 89 is released, the spring 95 (see FIG. 5) causes the adjustable extension leg 47 (see FIG. 6) to be locked to the side members 11 and 12.

The sheath 82 (see FIG. 5) of the Bowden cable 81 also is secured near its bottom end to the flat bar 60 by a wire keeper 96. This position is above the upper latch bolt barrel 67.

The bottom end of the adjustable extension leg 47 (see FIG. 1) has a crutch tip 98 mounted thereon. The crutch tip 98 is formed of a suitable material such as rubber, for example, for cushioning purposes and skid resistance during ambulation.

The crutch tip 98 retains a toe chain 99 on the adjustable extension leg 47. The free end of the toe chain 99 has a rubber tube 100 slipped thereover. Thus, the adjustable extension leg 47 is held against the floor by the therapist stepping on the rubber tube 100 while lifting the side members 11 and 12 upwardly through release of the latch bolts 68 and 71 by clockwise pivoting of the lever 89 so that the shoulder saddle 14 can be positioned beneath the arm pit of the person being fitted.

The lower portion of the tube 45 has a circular opening 101 to enable viewing of raised indicia 102 on the adjustable extension leg 47. One of the indicia 102 is disposed in the same horizontal plane as each pair of the holes 69 except for the lowermost pair of the holes 69 in the adjustable extension leg 47 and the three uppermost pairs of the holes 69 in the adjustable extension leg 47. The indicia 102 have numbers from one to fifteen, for example, in ascending order. It should be understood that the numbers may be from one to a lesser or greater number than fifteen.

The liner 46 has a longitudinal slot 103 formed therein for the entire length of the liner 46. This prevents removal of the raised indicia 102 during relative vertical movement between the adjustable extension leg 47 and the liner 46 and the tube 45. The slot 103 also enables viewing of the indicia 102 on the adjustable extension leg 47.

Considering the operation of the present invention, the therapist supports the patient while holding the crutch gauge 10. The crutch gauge 10 is positioned with the shoulder saddle 14 beneath the arm pit of the person, who is being fitted, with the therapist standing on the rubber tube 100 on the toe chain 99. Then, the therapist pivots the lever 89 clockwise about the pivot pin 90 to release the latch bolts 68 (see FIG. 6) and 71 from their locking positions so that there can be relative movement of the side members 11 and 12 with respect to the adjustable extension leg 47.

In order to be able to move the shoulder saddle 14 (see FIG. 1) upwardly and position it beneath the arm pit of the person, who is being fitted, the adjustable extension leg 47 is initially positioned relative to the side members 11 and 12 so that this can occur. Then, with the lever 89 pivoted clockwise and held in this position by the therapist, the side members 11 and 12 are raised upwardly until the shoulder saddle 14 is beneath the arm pit of the person, who is being fitted. At this time, the lever 89 is released so that the latch bolts 68 (see FIG. 6) and 71 are returned to their locking positions by the spring 95.

If the adjustable extension leg 47 is at the desired length, the person, who is being fitted, can use the crutch gauge 10 for a few minutes to see if it feels comfortable. Of course, at this time, the telescoping handle 32 (see FIG. 1) can be adjusted, as desired, for a comfortable fit. All of this occurs with the therapist in an upright position beside the person, who is being fitted, so that the therapist can provide any necessary assistance.

If the person, who is being fitted, decides that the overall length of the crutch gauge 10 is too short or too long, it is only necessary for the therapist to pivot the lever 89 clockwise to release the latch bolts 68 (see FIG. 6) and 71 from their locking positions and move the side members 11 and 12 upwardly or downwardly depending upon whether a greater or lesser overall length is desired. Then, the lever 89 (see FIG. 1) is released so that the spring 95 (see FIG. 6) returns the latch bolts 68 and 71 to their locking positions. Again, the person, who is being fitted, can use the crutch gauge 10 for support while walking to determine if the new length is comfortable.

Thus, this fitting occurs in a very short period of time. It does not require the therapist to ever bend over so that the therapist does not have to worry about proper support for the person, who is being fitted, during this time.

With the crutch gauge 10 being comfortable for the person, who is being fitted, the therapist now views the indicia 102 (see FIG. 1) through the circular opening 101 in the tube 45 to determine the hole in the extension leg of the crutch in which the lowermost of the two bolts and nuts, which are used to join the lower ends of the two side members to the extension leg in the standard crutch of metal or wood, are to be disposed. For example, if the number seven of the indicia 102 appears through the opening 101 in the tube 45, then the seventh pair of aligned holes from the bottom of the extension leg of the metal or wood crutch is utilized to receive the lowermost of the two bolts employed to join the extension leg to the two side members in the standard metal or wood crutch having the adjustable extension leg between two side members.

An advantage of this invention is that the crutch gauge can support the person, who is being fitted, so that the person can determine if the overall length of the crutch gauge is comfortable. Another advantage of this invention is that it does not require the person, who is measuring the person to be fitted with the crutch, to bend over to make any adjustment. A further advantage of this invention is that the crutch gauge can be easily adjusted in either direction.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A crutch gauge for determining the length of a crutch for a person including:

a pair of side members;

a plurality of securing means to secure said side members to each other at spaced longitudinal portions;

one of said securing means securing said side members to each other adjacent their lower ends, said one securing means being disposed between said side members adjacent their lower ends;

said one securing means having longitudinal passage means extending therethrough;

an adjustable extension leg extending through said longitudinal passage means in said one securing means to engage a floor or the like to support said side members;

longitudinal guide means for said adjustable extension leg;

said longitudinal guide means being supported by said side members and extending into the upper end of said adjustable extension leg to allow said adjustable extension leg to have only longitudinal relative movement with respect to said longitudinal guide means;

releasable locking means to releasably lock said adjustable extension leg to said one securing means;

said releasable locking means including:

a pair of movable means carried by said longitudinal guide means and spaced longitudinally from each other;

longitudinally spaced receiving means in said one securing means to receive each of said pair of movable means;

and a plurality of longitudinally and equally spaced enabling means in said adjustable extension leg to enable each of said pair of movable means to pass through one of said enabling means into one of said receiving means to lock said adjustable extension leg to said one securing means;

and means to render said releasable locking means ineffective while each of said securing means remains effective to enable relative movement between said side members and said adjustable extension leg so that the overall length of a crutch may be determined.

2. The crutch gauge according to claim 1 in which said rendering means includes means to cause substantially simultaneous withdrawal of each of said pair of movable means from one of said receiving means and one of said enabling means in said adjustable extension leg to unlock said adjustable extension leg from said one securing means.

3. The crutch gauge according to claim 2 including resilient means to continuously urge each of said pair of movable means into one of said receiving means when said rendering means is not effective.

4. The crutch gauge according to claim 3 in which at least one of said adjustable extension leg and said one securing means has indicating means to indicate the position of said adjustable extension leg with respect to said side members to enable determination of the overall length of a crutch for the person.

5. The crutch gauge according to claim 1 in which at least one of said adjustable extension leg and said one securing means has indicating means to indicate the position of said adjustable extension leg with respect to said side members to enable determination of the overall length of a crutch for the person.

6. The crutch gauge according to claim 1 in which:

said adjustable extension leg is a hollow tube;

said tube includes closure means at its upper end substantially closing its upper end, said closure means has an opening therein;

said longitudinal guide means includes a flat bar of rectangular cross section substantially the same size as said opening in said closure means of said tube and extending into the upper end of said tube through said opening in said closure means of said tube;

said flat bar is supported by another of said securing means;

said releasable locking means includes:

first support means supported by said flat bar within said tube;

and second support means supported by said flat bar within said tube, said second support means being spaced longitudinally from said first support means and being disposed near the bottom of said flat bar;

said pair of movable means of said releasable locking means includes a first locking element slidably supported by said first support means and a second locking element slidably supported by said second support means;

said longitudinally spaced receiving means in said one securing means includes first receiving means aligned with said first support means to receive said first locking element and second receiving means aligned with said second support means to receive said second locking element;

and said enabling means of said releasable locking means includes enabling means longitudinally spaced from each other along said tube at substantially equal distances and disposd on diametrically opposite sides of said tube to enable said first locking element supported by said first support means to pass through one of said enabling means into said first receiving means and said second locking element supported by said second support means to pass through another of said enabling means into said second receiving means to lock said adjustable extension leg to said one securing means.

7. The crutch gauge according to claim 6 in which:

said first support means extends through the portion of said flat bar within said tube;

said first support means has substantially horizontal passage means to slidably support said first locking element therein;

said second support means extends through the portion of said flat bar within said tube;

and said second support means has substantially horizontal passage means to slidably support said second locking element.

8. The crutch gauge according to claim 7 in which:

said rendering means includes:

single actuating means connected to said first locking element and said second locking element;

and moving means connected to said single actuating means intermediate the connection of said single actuating means to said first locking element and said second locking element to simultaneously withdraw said first locking element from said first receiving means in said one securing means and one of said enabling means in said tube and said second locking element from said second receiving means in said one securing means and another of said enabling means in said tube;

and resilient means acting on said single actuating means to continuously urge said first locking element into said first receiving means in said one securing means and one of said enabling means in said tube and said second locking element into said second receiving means in said one securing means and another of said enabling means in said tube.

9. The crutch gauge according to claim 8 in which said moving means of said rendering means includes:

cable means connected to said single actuating means;

and activating means connected to said cable means, said activating means being disposed adjacent the upper ends of said side members and above each of said securing means except the uppermost of said securing means to move said cable means to simultaneously withdraw said first locking element from said first receiving means in said one securing means and one of said enabling means in said tube and said second locking element from said second receiving means in said one securing means and another of said enabling means in said tube.

10. The crutch gauge according to claim 9 in which:

said single actuating means includes an actuator having one end connected to said first locking element on one side of said flat bar and its other end connected to said second locking element on the other side of said flat bar;

and said flat bar has passage means extending therethrough to have said actuator pass therethrough.

11. The crutch gauge according to claim 10 in which:

said tube has indicia means thereon to indicate the position of said tube with respect to said side members to enable determination of the overall length of a crutch for the person;

and said one securing means has an opening therein to view the one of said indicia means that indicates the position of said tube with respect to said side members to enable determination of the overall length of a crutch for the person.

12. The crutch gauge according to claim 11 including means attached to said tube to enable retaining of said tube against movement while said side members are moved relative thereto when said rendering means is effective.

13. The crutch gauge according to claim 12 in which:

each of said enabling means in said tube includes a pair of diametrically disposed openings in said tube;

and each of said first and second receiving means in said one securing means includes an opening in said one securing means to receive one of said first and second locking elements, one of said openings being on one side of said one securing means and the other of said openings being on the other side of said one securing means.

14. The crutch gauge according to claim 6 in which:

each of said enabling means in said tube includes a pair of diametrically disposed openings in said tube;

and each of said first and second receiving means in said one securing means includes an opening in said one securing means to receive one of said first and second locking elements, one of said openings being on one side of said one securing means and the other of said openings being on the other side of said one securing means.

15. The crutch gauge according to claim 6 in which:

said tube has indicia means thereon to indicate the position of said tube with respect to said side members to enable determination of the overall length of a crutch for the person;

and said one securing means has an opening therein to view the one of said indicia means that indicates the position of said tube with respect to said side members to enable determination of the overall length of a crutch for the person.

16. The crutch gauge according to claim 1 in which:

said adjustable extension leg has indicia means thereon to indicate the position of said adjustable extension leg with respect to said side members to enable determination of the overall length of a crutch for the person;

and said one securing means has an opening therein to view the one of said indicia means that indicates the position of said adjustable extension leg with respect to said side members to enable determination of the overall length of a crutch for the person.

17. The crutch gauge according to claim 1 in which:

each of said enabling means in said adjustable extension leg includes a pair of diametrically disposed openings in said adjustable extension leg;

and each of said longitudinally spaced receiving means in said one securing means includes an opening in said one securing means to receive one of said pair of movable means, one of said openings being on one side of said one securing means and the other of said openings being on the other side of said one securing means.

18. The crutch gauge according to claim 1 in which said rendering means includes:

removing means to simultaneously remove each of said pair of movable means of said releasable locking means from said enabling means in said adjustable extension leg and said receiving means in said one securing means to unlock said adjustable extension leg from said one securing means;

and said removing means including actuating means adjacent the upper ends of said side members and above each of said securing means except the uppermost of said securing means to actuate said removing means to unlock said adjustable extension leg from said one securing means.

19. The crutch gauge according to claim 1 in which one of said pair of movable means is disposed in substantially the same plane as the bottom of each of said side members.

20. A crutch gauge for determining the length of a crutch for a person including:

a pair of side members, each of said side members having its lower portion angled inwardly toward the lower portion of the other of said side members;

a plurality of securing means to secure said side members to each other at spaced longitudinal portions;

one of said securing means securing said lower portions of said side members to each other adjacent their lower ends, said one securing means being disposed between said lower portions of said side members adjacent their lower ends;

said one securing means comprising:

a hollow tube having longitudinal passage means extending therethrough;

and means to secure said hollow tube to said lower portion of each of said side members;

and adjustable extension leg extending through said longitudinal passage in said one securing means to engage a floor or the like to support said side members;

longitudinal guide means for said adjustable extension leg;

said longitudinal guide means being supported by said side members and extending into the upper end of said adjustable extension leg to allow said adjustable extension leg to have only longitudinal relative movement with respect to said longitudinal guide means;

releasable locking means to releasably lock said adjustable extension leg to said one securing means;

said releasable locking means including:

a pair of movable means carried by said longitudinal guide means and spaced longitudinally from each other;

longitudinally spaced receiving means in said one securing means to receive each of said pair of movable means;

and a plurality of longitudinally and equally spaced enabling means in said adjustable extension leg to enable each of said pair of movable means to pass through one of said enabling means into one of said receiving means to lock said adjustable extension leg to said one securing means;

and means to render said releasable locking means ineffective while each of said securing means remains effective to enable relative movement between said side members and said adjustable extension leg so that the overall length of a crutch may be determined.

* * * * *

UNITED STATES PATENT AND TRADEMARK OFFICE

CERTIFICATE OF CORRECTION

PATENT NO. : 4,386,466

DATED : June 7, 1983

INVENTOR(S) : LeRoy J. Lee

It is certified that error appears in the above—identified patent and that said Letters Patent is hereby corrected as shown below:

Column 3, line 51, "The" should read --- This ---.

Column 7, line 42, "47" (second occurrence) should read --- 67 ---.

Column 15, line 8, "and" should read --- an ---.

Signed and Sealed this

*Eighth* Day of *November 1983*

[SEAL]

*Attest:*

GERALD J. MOSSINGHOFF

*Attesting Officer*

*Commissioner of Patents and Trademarks*